United States Patent [19]

McKnight

[11] 4,287,265

[45] Sep. 1, 1981

[54] FLOATING CORNER FOR INSERTION INTO A PACKING CONTAINER

[76] Inventor: Joseph H. McKnight, 2298 Calabazas Blvd., Santa Clara, Calif. 95051

[21] Appl. No.: 746,701

[22] Filed: Dec. 2, 1976

[51] Int. Cl.[3] ..... B65D 81/02

[52] U.S. Cl. ..... 428/542; 206/586; 229/DIG. 1; 428/218

[58] Field of Search ..... 206/326, 453, 586; 229/14 C, DIG. 1; 217/5.3; 248/345.1; 428/542, 53, 133, 139, 170, 140, 218

[56] References Cited

U.S. PATENT DOCUMENTS

| | | | |
|---|---|---|---|
| 2,324,031 | 7/1943 | Schiffenhaus | 206/586 |
| 3,088,647 | 5/1963 | Zastrow | 217/53 X |
| 3,278,365 | 10/1966 | Adams et al. | 428/538 X |
| 3,344,973 | 10/1967 | Studen | 229/14 C X |
| 3,356,209 | 12/1967 | Pezely, Jr. | 206/586 X |
| 3,361,322 | 1/1968 | Gabriel et al. | 229/14 C |
| 3,658,972 | 4/1972 | Ready et al. | 428/425 X |
| 3,739,730 | 6/1973 | Horowitz | 428/542 X |
| 3,785,066 | 1/1974 | Tuitt | 428/542 X |
| 3,973,720 | 8/1976 | Schmid | 428/542 X |

*Primary Examiner*—Henry F. Epstein
*Attorney, Agent, or Firm*—Claude A. S. Hamrick

[57] ABSTRACT

A floating corner for insertion into an outer packing container to protect an object carried in an inner container, the corner comprising a square sheet having opposed first and second edges and opposed third and fourth edges arranged so that a line bisecting the first and second edges defines a first reference line and a line passing through the third and fourth edges normal to the first reference line defines a second reference line, the sheet including a slot extending along the second reference line from the third edge to the first reference line, the lines forming the sheet into first, second, third and fourth sections, each having a respective opening, the sheet being folded about the first and second lines into a generally corner configuration with the first section overlaying the second section and with the respective first and second openings in alignment, and first, second, and third blocks, each comprised of a firm, spongy, resilient material and having opposed first and second surfaces and a sidewall, the first block being disposed through the aligned first and second openings, the second block being disposed through the third opening and the third block being disposed through the fourth opening such that the first surfaces are adapted to contact the adjacent walls of an outer container and the second surfaces are adapted to contact adjacent surfaces of an inner container, the resilient material urging the sidewalls into engagement with the respective openings so as to secure the blocks to the sheet, whereby the blocks serve to absorb energy transmitted through the outer container and protect an object when it is carried in the inner container.

11 Claims, 5 Drawing Figures

FLOATING CORNER FOR INSERTION INTO A PACKING CONTAINER

BACKGROUND OF THE INVENTION

1. Field of the Invention

The present invention relates generally to shock-absorbing devices for insertion into packing containers, and more particulary, to a floating corner that is simply assembled for insertion into a packing container to protect an object carried in the container.

2. Description of the Prior Art

Heretofore, shock-absorbing devices formed from a foam-like material have commonly been inserted into packing containers to protect an object carried in the container by isolating it from energy caused by bumps, etc., transmitted through the walls of the container. Such devices typically are used to protect delicate electronic instruments such as computers, disc drives, voltmeters, etc., and comprise a multiplicity of polyurethane sections glued or otherwise attached together into a massive, integral structure. The structure often includes four corners interconnected by four elongated sides and serves to protect an entire surface of an inner carton which contains the instrument. The problem associated with such devices is that they occupy a relatively large amount of space. Consequently, shipping costs for transporting the empty shipping devices to a desired location are relatively expensive. In addition, relatively large quantities of material are required to fabricate the structures. This further increases their cost. Moreover, in view of the recent energy crisis, the material is difficult to obtain since it is a derivative product of petroleum.

SUMMARY OF THE PRESENT INVENTION

Accordingly, it is an object of the present invention to provide a floating corner for insertion into a packing container which is capable of being simply assembled and disassembled, and which can be fabricated at a relatively low cost.

Another object of the present invention is to provide a floating corner which utilizes relatively small quantities of shock-absorbing material and which is capable of being stored in a relatively small space.

Briefly, the preferred embodiment includes a square corrugated or cardboard sheet having a slot extending from its midpoint to a midpoint of an edge so as to form the sheet into four sections, each of the sections having a central square opening, the sheet being folded into a generally corner configuration with the openings of two overlaid sections in alignment, and first, second, and third blocks, each comprised of a firm, spongy, resilient material and having opposed first and second surfaces and a sidewall, the first block being disposed through the aligned openings and the second and third blocks being disposed through the remaining openings such that the first surfaces are adapted to contact the adjacent walls of an outer container and the second surfaces are adapted to contact adjacent surfaces of an inner container, the resilient material urging the sidewalls into engagement with the respective openings so as to secure the blocks to the sheet, whereby the blocks serve to absorb energy transmitted through the outer container and protect an object when it is carried in the inner container.

An advantage of the present invention is that it is simply assembled and disassembled by merely placing the blocks in the openings and when disassembled occupies a relatively small storage space.

Another object of the present invention is that it utilizes relatively small quantities of resilient material and can be fabricated at a relatively low cost.

Still another object of the present invention is that it can be transported to selected locations at a relatively low cost.

The foregoing and other objects, features and advantages of the invention will be apparent from the following detailed description of the preferred embodiments illustrated in the several figures of the drawing.

IN THE DRAWING

DETAILED DESCRIPTION OF THE PREFERRED EMBODIMENTS

Figure 1:
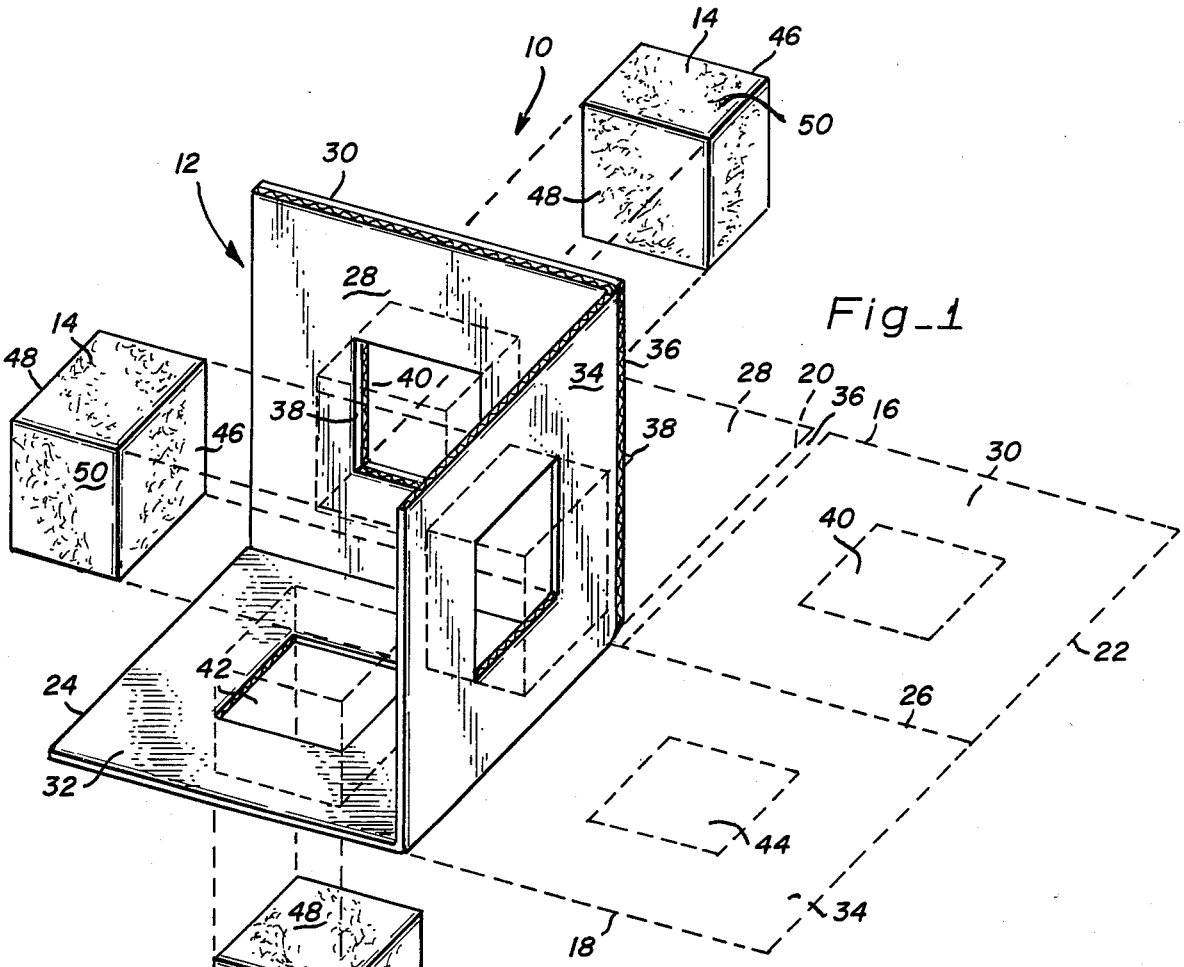
FIG. 1 is an exploded view of a floating corner in accordance with the present invention with the sheet in the unfolded position being illustrated in dashed lines.
Figure 2:
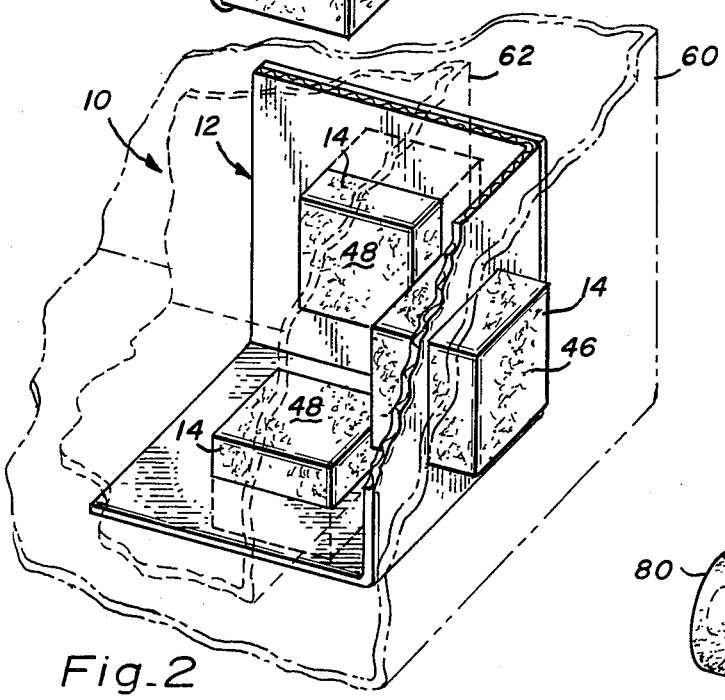
FIG. 2 is a partial perspective view of the floating corner of FIG. 1 with the outer container and the inner container illustrated in dashed lines.

FIGS. 1 and 2 illustrate in an exploded and in a partial perspective view, respectively, a floating corner 10 in accordance with the present invention. The corner 10 includes a sheet 12 and three blocks 14.

With reference to FIG. 1, the sheet 12 is comprised of a rigid material that is capable of being folded and has a generally rectangular shape in plan view. The sheet, illustrated in the flat or unfolded condition by the dashed lines, includes opposed edges 16 and 18 that are substantially parallel to one another and arranged such that a line 20 which bisects the edges 16 and 18 defines a first reference line. Opposed edges 22 and 24, respectively connect corresponding corners of the edges 16 and 18 and are arranged such that a line 26, which bisects the edges 22 and 24, defines a second reference line normal to the reference line 20. The line 20 and 26 form the sheet into four equal sections 28, 30, 32 and 34. A slot 36 is formed in the section 30 with a border along the reference line 20. The slot 36 extends from the edge inwardly toward the midpoint or intersection of the lines 20 and 26 and divides the sheet into two portions. Identical openings 38–44 are formed in the central area of the sections 28–34, respectively. Each opening has a generally square border.

In the preferred embodiment, the sheet is comprised of a paper fibreboard such as a corrugated three-ply cardboard, and has a square shape with each edge being about 12 inches; and the opening has a square shape with each border dimension being about 2 and ½ inches. Alternatively, the sheet can be comprised of chip board. However, sheets formed by die-cutting corrugated cardboard have been found to have less of a tendency to shear the foam than those comprised of chip board, or similar single wall media.

The blocks 14 are identical in construction and are comprised of a firm, spongy, resilient material having a generally square shape. Each block includes opposed surfaces 46 and 48 with a sidewall 50 therebetween. The sidewall 50 has a cross section which is greater in area than that of the corresponding opening 38–44.

In the preferred embodiment, the blocks are formed from polyurethane with each side being about 2 and ¾ inches. Alternatively, the blocks can be formed from expanded polyethylene material or any other foam-like material having compressible air cells therewithin.

In accordance with the present invention, the sheet 12 is folded about the line 26 and then about the line 20 into a generally corner configuration with the section 28 overlaying the section 30 and with the openings 38 and 40 in substantial alignment. Thereafter, the three blocks 14 are inserted through the aligned openings 38 and 40 and the openings 42 and 44, respectively. Because of the reslient characteristic and the larger cross-section of the blocks, the sidewalls 50 are urged into engagement with the borders of the openings 38–44 so as to secure the blocks to the sheet 12. The blocks serve to maintain the sheet in the corner configuration. When configured as described, the assembly is commonly referred to as a "floating corner".

Figure 3:
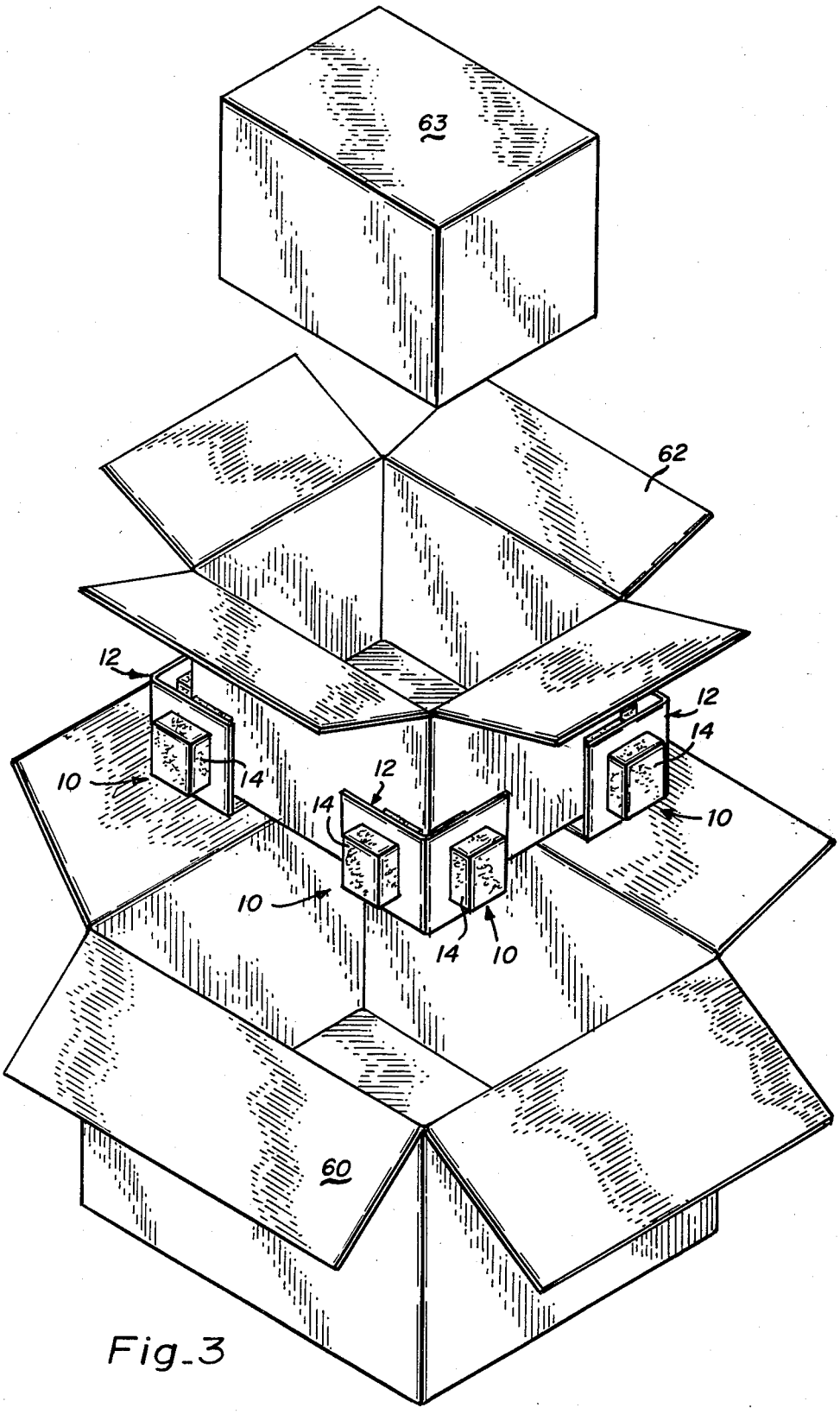
FIG. 3 is an exploded perspective view illustrating the floating corners, the inner and outer containers and the object carried in the inner container.

In operation, the floating corner 10 is inserted in each corner of a packing container illustrated by the dashed lines 60 of FIG. 2 with the respective outer surfaces 46 against the adjacent walls of the container 60. Thereafter, an inner container or carton illustrated partially by the dashed lines and the cross hatch 62 is placed in the container 60 on the corners 10 in such a manner that it is supported by the corresponding inner surfaces 48 of each of the corners 10. A delicate instrument 63 such as a computer, voltmeter, etc. is then placed in the inner container 62. An exploded perspective view of the floating corners 10, the outer container 60, the inner container 62 and the instrument 63 is shown in FIG. 3. In use the blocks 14 serve to absorb energy transmitted through the container 60 to protect the instrument 63 when it is carried in the inner container 62.

Because of its unique construction, when not in use the corners are disassembled by simply removing the blocks and unfolding the sheets. As previously described, the flat sheets and component blocks are capable of being stored in a relatively small space and therefore may be easily re-cycled.

It should be recognized by those skilled in the art that the thickness of the several blocks can differ. For example, the blocks supporting and protecting the bottom surface of the inner carton can be 3 inches thick and the blocks protecting the side and top surfaces can be 2 inches thick. It should also be recognized that the blocks could be varied in both density and composition for customized packaging of specific items from a variety of stock raw materials.

Figure 4:
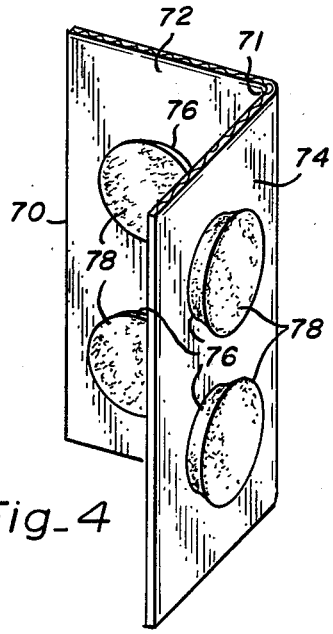
FIG. 4 is a perspective view of another embodiment of the present invention.

Referring now to FIG. 4, an alternative embodiment of the present invention is illustrated. As shown, a sheet 70 foldable about the line 71 includes two sections 72 and 74, each having a pair of circular openings 76. Four polyurethane blocks 78 each being identical in construction and having a generally cylindrical shape are selectively inserted through the respective openings 76 thus forming the assembly into a two dimensional floating corner. As previously described, a multiplicity of the floating corners are inserted into a packing container (not shown) to protect an instrument or the like that is carried in an internal floating container. In the embodiment, the opening and the block may be of any shape, and for example, this two dimensional corner may be made up in stock lengths for subsequent custom cutting.

Figure 5:
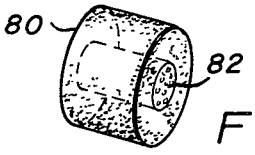
FIG. 5 is a perspective view of an alternative embodiment of the block.

With reference to FIG. 5, an alternative embodiment of the block 78 is illustrated. As shown, the block 80 is comprised of a firm, spongy, resilient material and has an opening with a core 82 inserted therein. The core 82 is formed from a material with a relatively high density compared to the material forming the block. This strengthens and provides greater rigidity to the block when it is formed into a floating corner.

From the above, it can be seen that a floating corner has been described which fulfills all of the objects and advantages set forth above.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A floating corner which when assembled is for insertion into an outer packing container to protect an object in an inner container, and when disassembled may be stored and shipped compactly, comprising:

a sheet of generally rigid first material having first, second and third intersecting fold lines and a slot substantially linearly aligned with said second fold line, said fold lines and said slot dividing said sheet into first, second, third and fourth portions, each having an opening provided therein, the openings in said first and fourth portions being identical in configuration and positioned so as to be aligned with each other when said sheet is folded along said second fold line, the sheet being adapted to fold so that said third portion may be oriented normal to said second portion and said first and fourth portions may be rotated about said first and third fold lines respectively, into substantially coplanar positions; and first, second and third blocks of firm, spongy, resilient second material, each having opposed first and second surfaces and a sidewall between said first and second surfaces having a perimeter slightly larger than said openings, each said block being adapted for compressive disposition within one of said openings with said first surface spaced from one surface of said sheet and adapted to contact a wall of an outer container and said second surface spaced from the opposite surface of said sheet and adapted to contact a surface of an inner container, whereby when the corner is assembled by folding said sheet and disposing said blocks through said openings and then is appropriately positioned between an inner container and an outer container, said blocks serve to absorb energy transmitted through the outer container to protect an object carried in the inner container, and when said corner is disassembled for shipment or storage the blocks are separated from the sheet and the sheet is unfolded so that it can be laid flat.

2. A floating corner as recited in claim 1 wherein said first material is comprised of cardboard and said second material is a foamed plastic.

3. A floating corner as recited in claim 2 wherein said second material is a foamed polyurethane.

4. A floating corner as recited in claim 1 wherein said openings are square and said blocks each have a square cross-section that is greater than that of said opening.

5. A floating corner for insertion into an outer packing container to protect an object carried in an inner container comprising:

a sheet of generally rigid first material having a generally rectangular shape and opposed first and second edges and opposed third and fourth edges arranged so that a line bisecting said first and second edges defines a first reference line and a line passing through said third and fourth edges normal to said first reference line defines a second reference line, said sheet including a slot extending along said second reference line from said third edge to said first reference line, said lines forming said sheet into first, second, third and fourth sections, each having a respective opening, said sheet being folded about said first and second lines to form a three sided structure wherein said first section is in overlaying relationship with said second section and the respective openings therein are in alignment, said first and second sections being disposed to lie in a plane that is normal to the planes of said third and fourth sections; and first, second and third blocks, each comprised of a firm, spongy, resilient second material and having opposed first and second surfaces and a sidewall between said first and second surfaces, said first block being disposed to extend through said aligned first and second openings, said second block being disposed to extend through the third opening, and said third block being disposed to extend through the fourth opening such that said first surfaces are spaced from one surface of said sheet and are adapted to contact the adjacent walls of an outer container and said second surfaces are spaced from another surface of said sheet and are adapted to contact adjacent surfaces of an inner container, whereby said blocks serve to absorb energy transmitted through the outer container and protect an object when it is carried in the inner container.

6. A floating corner as recited in claim 5 wherein said sheet has a generally square shape.

7. A floating corner as recited in claim 5 wherein said first material is paper fibreboard and said second material is a foamed polyurethane.

8. A floating corner as recited in claim 5 wherein said openings are square and said blocks have a square cross-section that is greater than that of said respective openings.

9. A floating corner as recited in claim 5 wherein said first material is paper fibreboard and said second material is polyethylene.

10. A floating corner as recited in claim 5 wherein said openings are round and said blocks have a circular cross-section with a diameter greater than that of said respective opening.

11. A floating corner as recited in claim 5 wherein said block includes an aperture and further comprising a core formed from a third material having a density greater than that of said second material and being disposed in said aperture, said core serving to strengthen said block in a longitudinal direction between said first and second surfaces.

* * * * *